US006630800B2

(12) United States Patent
Weng

(10) Patent No.: US 6,630,800 B2
(45) Date of Patent: Oct. 7, 2003

(54) REMOTE-CONTROL DEVICE OF LAMP SERIES CONTROL BOX

(75) Inventor: Linsong Weng, Chu-Pei (TW)

(73) Assignee: Hugewin Electronics Co., Ltd., Chu-Pei (TW)

( * ) Notice: Subject to any disclaimer, the term of this patent is extended or adjusted under 35 U.S.C. 154(b) by 0 days.

(21) Appl. No.: 10/035,426

(22) Filed: Jan. 4, 2002

(65) Prior Publication Data

US 2003/0127990 A1 Jul. 10, 2003

(51) Int. Cl.[7] ..... H05B 41/36
(52) U.S. Cl. ..... 315/291
(58) Field of Search ..... 315/291, 293, 315/294, 292, 320, 314, 316, 185 R, 185 S, 193; H05B 37/02; G05F 1/00

(56) References Cited

U.S. PATENT DOCUMENTS 5,909,087 A * 6/1999 Bryde et al. ..... 315/149
6,020,825 A * 2/2000 Chansky et al. ..... 340/825.22
6,072,395 A * 6/2000 Vega ..... 340/573.1
6,380,696 B1 * 4/2002 Sembhi et al. ..... 315/294
6,424,096 B1 * 7/2002 Lowe et al. ..... 315/185 R
6,457,681 B1 * 10/2002 Wolf et al. ..... 246/187 A

* cited by examiner

*Primary Examiner*—Don Wong
*Assistant Examiner*—Trinh Vo Dinh
(74) *Attorney, Agent, or Firm*—Rosenberg, Klein & Lee

(57) ABSTRACT

The present invention provides a remote-control device of lamp series control box comprising a handheld remote controller, which is used to emit out a remote-control signal. An RF receiving device is installed in the lamp series control box connecting a plurality of lamp series. After the RF receiving device receives the remote-control signal, different glittering mode of lamp series and music melody are generated according to the operation of a control module in the lamp series control box. A manual serial code learning switch and a manual serial code reset switch are disposed on the lamp series control box to learn inbuilt remote-control serial codes of different remote controllers. The present invention has the advantage of remotely controlling different glittering modes of lamp series and music melodies, and can let different remote controllers control a plurality of control boxes simultaneously.

9 Claims, 4 Drawing Sheets

REMOTE-CONTROL DEVICE OF LAMP SERIES CONTROL BOX

FIELD OF THE INVENTION

The present invention relates to a remote-control device and, more particularly, to a remote-control device of control box, which controls the glittering mode and played music melody of a Christmas lamp series in wireless remote-control way.

BACKGROUND OF THE INVENTION

Along with enhancement of living standards, people more appreciate savor of life. Usually, decorations or illuminations are furnished to embellish and build festive mood in some festivals, especially on Christmas. Presently, commercially available Christmas illuminations utilize a single-key control box to control music playing and light glittering of lamp series. Because the conventional control box uses the box body to connect a respectable, a user must plug or pull out the plug himself to open or close the illumination system. Moreover, the user must press the key on the control box to make selection of music playing or light glittering of lamp series. Therefore, the operation is inconvenient. Besides, the conventional control box provides various kinds of music to be selected by the user by means of pressing the key. However, after a piece of music is played, the system will automatically play the next music. If the user wants to listen to the same music again, he must set on the control box anew, resulting in inconvenience and trouble in use.

Along with continual development of scientific technology, many people more emphasize convenience and agility in life, letting wireless remote-control way being widely applied in everyday life. In order to let people conveniently and flexibly control the operation of a Christmas lamp series and achieve the functions of selecting a fixed music and remotely controlling selection of music, the present invention propose a remote-control device of control box, which controls the glittering mode and played music of a Christmas lamp series in wireless remote-control way.

SUMMARY OF THE INVENTION

The primary object of the present invention is to propose a remote-control device capable of remotely controlling a lamp series control box so that the lamp series control box can select different glittering modes of lamp series and have the advantages of selecting a fixed music and remotely controlling selection of music.

Another object of the present invention is to propose a remote-control device of lamp series control box, which utilizes mutual learning of remote-control signals to let a lamp series control box learn remote-control serial codes of different remote controllers so that the remote controllers having different remote-control serial codes can control a plurality of lamp series control boxes simultaneously.

Yet another object of the present invention is to propose a remote-control device of lamp series control box having an inbuilt user's code discrimination device so as to provide discrimination of user's code, hence ensuring usage safety of the lamp series control box.

Still yet another object of the present invention is to propose a remote-control device of lamp series control box of convenient use and simple operation.

A remote-control device of lamp series control box of the present invention comprises a handheld remote controller. A plurality of keys are disposed on the remote controller for selection of different functions of the lamp series control box and emission of remote-control signals corresponding to the functions. A radio-frequency (RF) receiving device is installed in the lamp series control box, which connects a plurality of lamp series. After the RF receiving device receives a remote-control signal, the glittering mode, music melody, and sound volume of the lamp series are controlled according to the operation of a control module in the lamp series control box set by the remote-control signal. A manual serial code learning switch and a manual serial code reset switch are disposed on the lamp series control box to learn inbuilt remote-control serial codes of different handheld remote controllers. The above handheld remote controller can be replaced with a telephone far-end remote controller so that the operation of the lamp series control box can be controlled by means of dial of telephone.

The various objects and advantages of the present invention will be more readily understood from the following detailed description when read in conjunction with the appended drawing, in which:

DETAILED DESCRIPTION OF THE PREFERRED EMBODIMENTS

Figure 1:
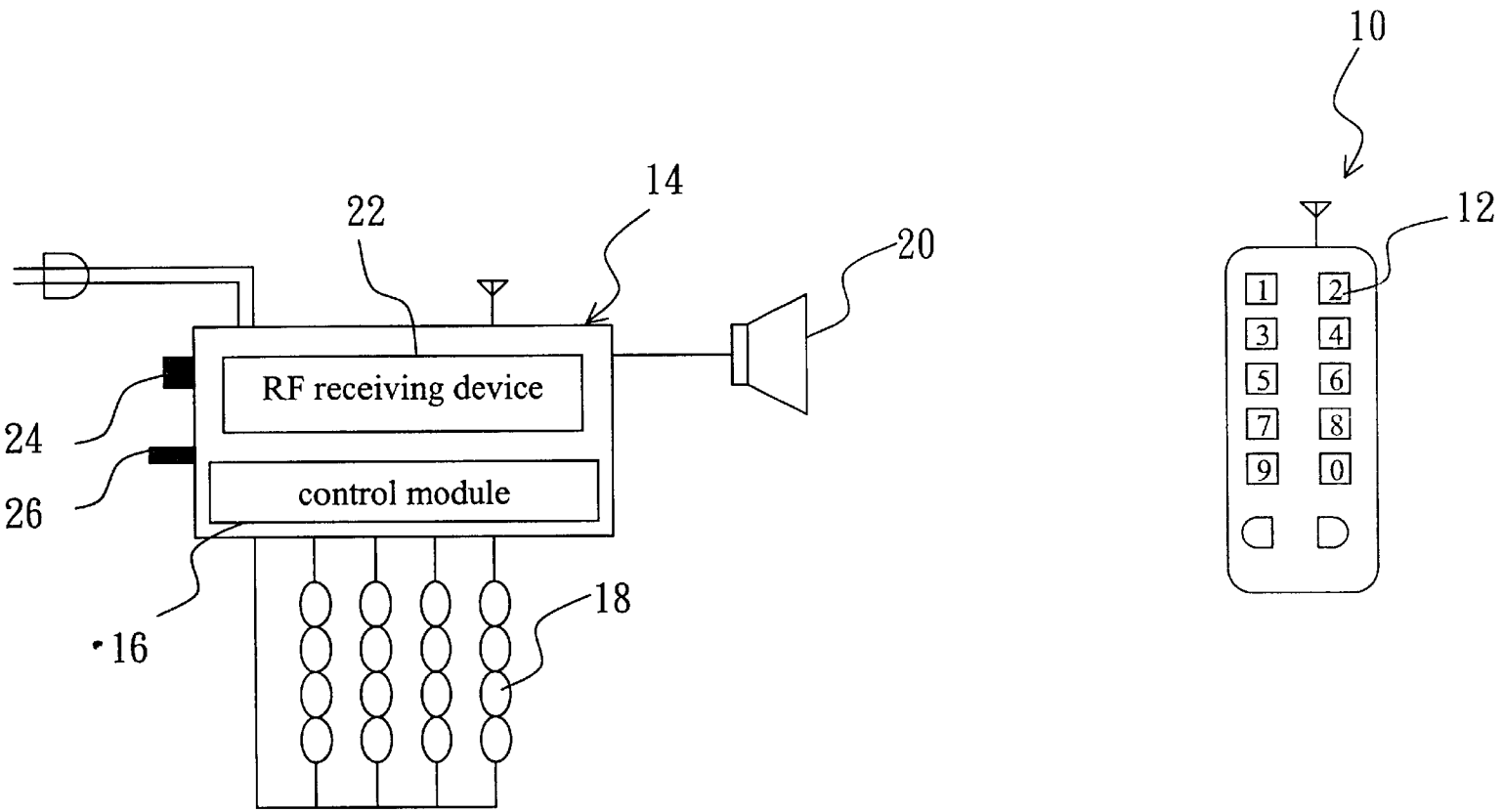
FIG. 1 is a structure diagram of the present invention.

As shown in FIG. 1, the present invention comprises a handheld remote controller 10 with a plurality of keys 12 disposed thereon. Pressing of each of the keys 12 means input of different electronic signals. The handheld remote controller 10 is used to emit out a remote-control signal according to different electronic signals. A lamp series control box 14 has a control module 16 of lamp series and music therein, and is electrically connected to a plurality of lamp series 18 and a speaker device 20. An RF receiving device 22 is installed in the lamp series control box 14. After the RF receiving device 22 receives a remote-control signal, the glittering mode, music melody, and sound volume of the lamp series are controlled according to the operation of a control module in the lamp series control box set by the pressed key.

The above control module 16 integrates control techniques of music and light, and has the functions of controlling on and off states of all, several, or a single lamp series and simultaneously playing different music melodies. Moreover, the control module 16 can match lamp series of different colors with different music, and can control sound volume. In the present invention, the selection of the key 12 of the handheld remote controller 10 will let different remote-control signals be emitted out to the control module 16 of the lamp series control box 14 so as to remotely control the specified light glittering and music playing mode of the lamp series 18 or light rotary mode of the lamp series 18. A manual serial code learning switch 24 is disposed on the lamp series control box 14 to learn inbuilt remote-control serial codes of different handheld remote controllers 10 so that the handheld remote controllers 10 having different remote-control serial codes can control a plurality of lamp series control boxes 14 simultaneously. A manual serial code reset switch 26 is disposed on the lamp series control box 14. Through switching of the serial code reset switch 26, remote-control serial codes learnt by the lamp series control box 14 can be cleared so that the lamp series control box 14 will not be controlled by some handheld remote controllers 10 having different remote-control serial codes.

Figure 2:
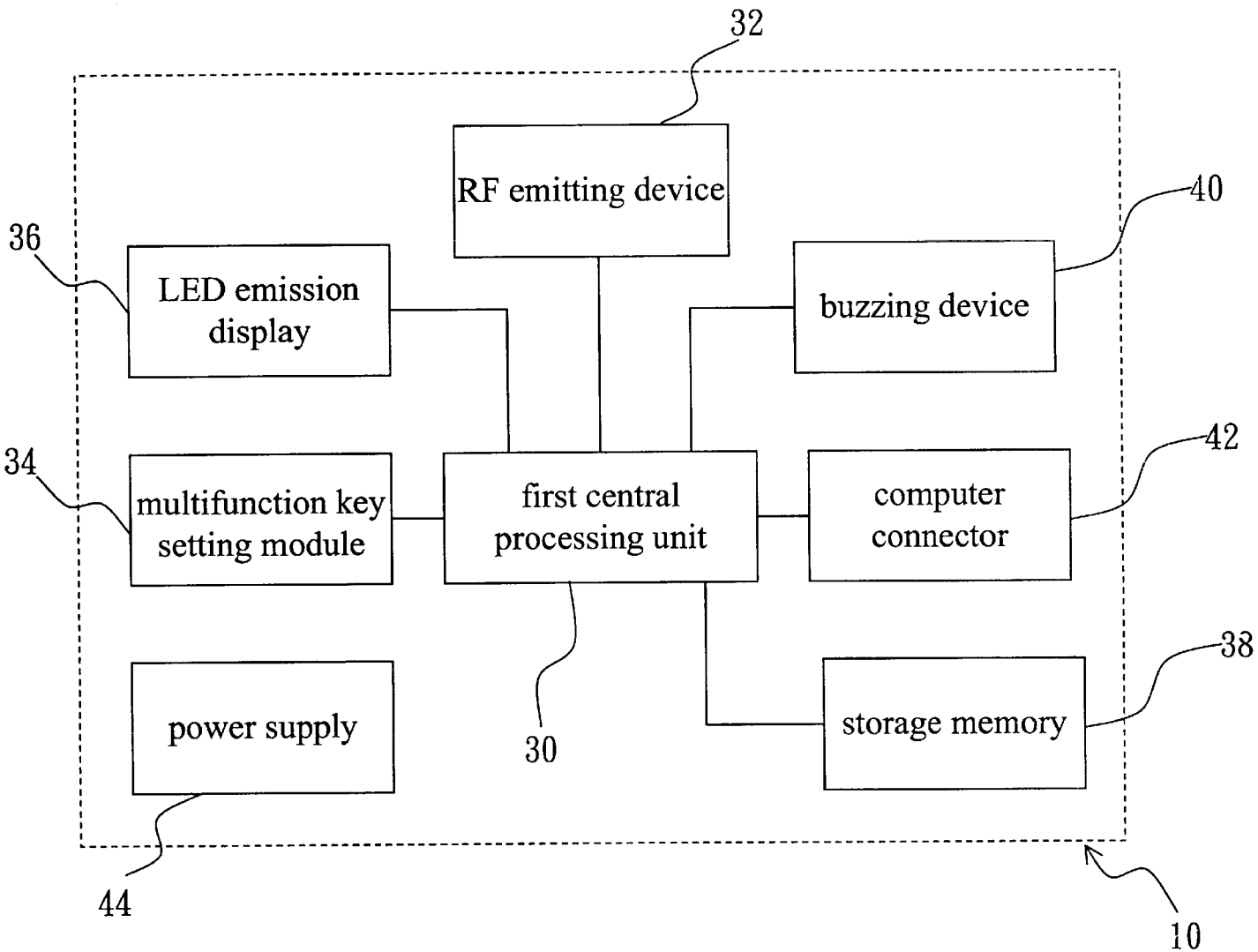
FIG. 2 is a structure block diagram of a handheld remote controller of the present invention.

The structures of the handheld remote controller 10 and the lamp series control box 14 will be described below to illustrate the characteristics of the present invention. As shown in FIG. 2, the handheld remote controller 10 comprises a first central processing unit (CPU) 30 connected to an RF emitting device 32, a multifunction key setting module 34, an LED emission display module 36, and a storage memory 38. The first CPU 30 receives the keyed-in signal of the multifunction key setting module 36 and then transfers it to the RF emitting device 32, which emits out a remote-control signal and a remote-control serial code of the handheld remote controller used by a user to the lamp series control box 14. Thereby, the control module 16 is set and controlled, and the key code is stored in the storage memory 38. The storage memory 38 is generally an electrically erasable programmable read-only memory (EEPROM). A buzzing device 40 connected to the first CPU 30 is also provided to give out buzzing sound during remote control. The LED emission display module 36 will emit out light to display emitting state. A computer connector 42 connected to the first CPU 30 is also disposed in the handheld remote controller 10 as a bridge between the handheld remote controller 10 and a computer. A power supply 44, generally being a battery set, is also provided to supply the required electricity for the above components.

Figure 3:
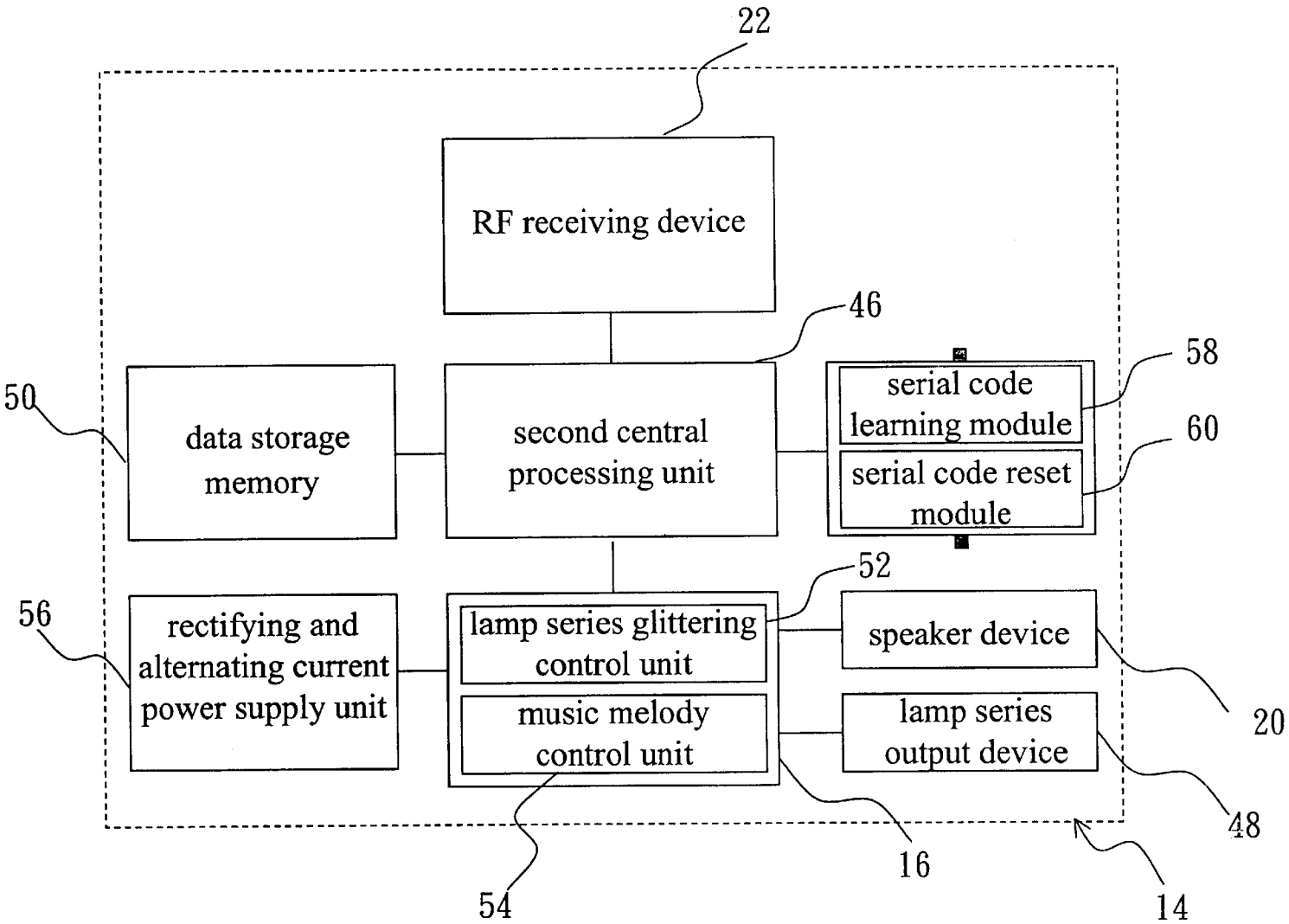
FIG. 3 is a structure block diagram of a lamp series control box of the present invention.

As shown in FIG. 3, the lamp series control box 14 comprises a second CPU 46 connected to an RF receiving device 22, a lamp series output device 48, a data storage memory 50, and the control module 16. The control module 16 comprises a lamp series glittering control unit 52 and a music melody control unit 54. The RF receiving device 22 is used to receive a remote-control signal emitted by the handheld remote controller 10 and let the second CPU 46 discriminate the remote-control signal according to the inbuilt remote-control serial codes of the handheld remote controller 10 stored in the data storage memory 50. After the remote-control serial code is confirmed, a control signal is transferred to the control module 16 to set the lamp series glittering control unit 52 or the music melody control unit 54. The control module 16 is connected to a rectifying and alternating current (AC) power supply unit 56, the speaker device 20, and the lamp series output device 48. The second CPU is also connected to a serial code learning module 58 and a serial code reset module 60. After the RF receiving device 22 receives a remote-control signal of the handheld remote controller 10, the serial code learning module 58 is used to learn remote-control serial codes of different handheld remote controllers 10 and then store them into the data storage memory 50, thereby letting handheld remote-controllers 10 having different remote-control serial codes control a plurality of lamp serial control boxes 14 simultaneously. Besides, the serial code reset module 60 is matched with the second CPU 46 for clearing the learnt remote-control serial codes.

Figure 4:
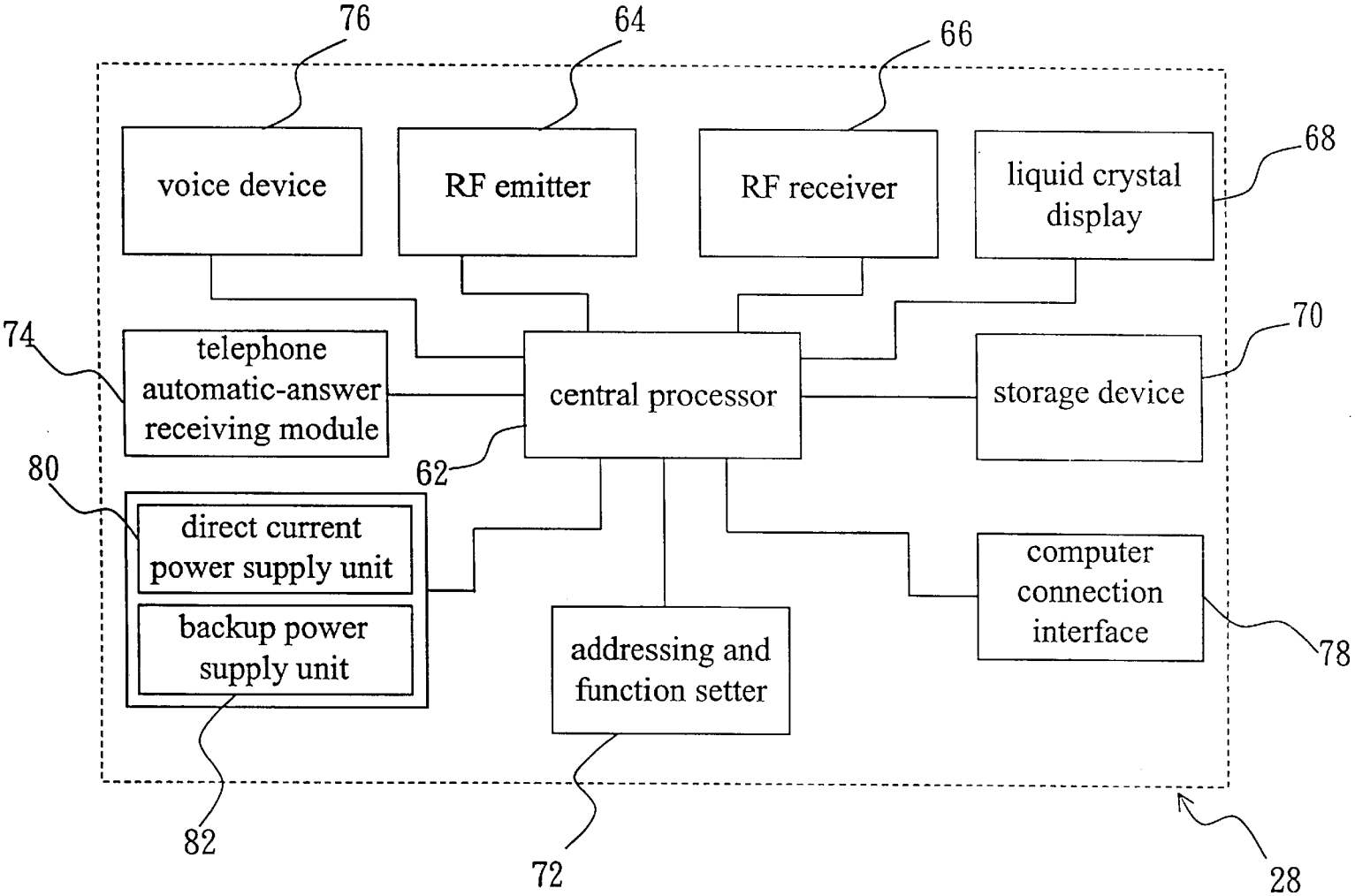
FIG. 4 is a structure diagram of a telephone far-end remote controller of the present invention.

In addition to remotely controlling the lamp series control box 14 using the above handheld remote controller 10, a telephone far-end remote controller 28 can be used to control the lamp series control box 14. As shown in FIG. 4, the telephone far-end remote controller 28 comprises a central processor 62 connected to an RF emitter 64, an RF receiver 66, an LCD display 38, a storage device 70, an addressing and function setter 72, a telephone automatic-answer receiving module 74, and a voice device 76. After the RF receiver 66 receives a remote-control signal of a handheld remote controller 10, the remote-control signal will be set in an address serial code of the addressing and function setter 72. The central processor 62 is used to receive the inputted address serial code of the addressing and function setter 72 and let the LCD display 68 display the set result simultaneously. The central processor 62 will also store the data into the storage device 70. The telephone automatic-answer receiving module 74 is connected to a public telephone switching system. When a user enters the telephone far-end remote controller 28 via telephone line, the voice device 76 will provide operation indications for him. Meanwhile, the telephone automatic-answer receiving module 74 will transfer the received telephone multi-frequency signals to the central processor 62, which will send out a control signal to be emitted out by the RF emitter 64, hence setting and controlling the lamp series control box 14. The central processor 62 is also connected to a direct current (DC) power supply unit 80 and a backup power supply unit 82, which are connected to the home AC system to provide electricity for the whole telephone far-end remote controller 28. A computer connection interface 78 connected to the central processor 62 is disposed in the telephone far-end remote controller 28 for connection with a computer.

A telephone multi-frequency discrimination device (not shown) is connected between the telephone automatic-answer receiving module 74 and the central processor 62 to provide discrimination of use's code, thereby ensuring usage safety of the lamp series control box 14.

To sum up, the design of the remote-control device of a lamp series control box of the present invention provides the function of remotely controlling the lamp series control box, avoiding the inconvenient situation that a user must operate the key 12 on the lamp series control box 14. Moreover, the learning function of the lamp series control box 14 can let different handheld remote controllers 10 or telephone far-end remote controllers 28 control a plurality of lamp series control boxes 14 simultaneously, avoiding the inconvenient situation that each lamp series control box 14 needs to be remotely controlled one by one when operating a plurality of lamp series control boxes 14.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A remote-control device of a lamp series control box, comprising:

a remote controller for emitting a remote-control signal according to an input electronic signal; and, a lamp series control box connecting a plurality of lamps in series connection, said lamp series control box having a radio-frequency receiving device used to receive said remote-control signal emitted by said remote controller, operation of a control box inside said lamp series control box being controlled according to said remote-control signal, said remote controller being selected from the group consisting of a handheld remote controller and a telephone far-end remote controller, said telephone far-end remote controller comprising a central processor connected to a radio frequency emitter, a radio frequency receiver, a storage device, and an addressing and function setter, said radio frequency receiver being used to receive a remote-control signal of said lamp series control box and set said signal into said addressing and function setter, said central processor being used to receive an input serial code of said addressing and function setter and display said input serial code on a liquid crystal display, said input serial code being stored in said storage device, said central processor being connected to a telephone automatic-answer receiving module to receive a telephone signal of a telephone line, said central processor processing said telephone signal and sending out a control signal to be emitted by said radio frequency emitter, a power supply unit being connected to said central processor.

2. The remote-control device of a lamp series control box as claimed in claim 1, wherein said handheld remote controller includes a plurality of electronic components comprising a central processing unit connected to a radio frequency emitting device, a multifunction key setting module, and a storage memory, said central processing unit being used to receive an input electronic signal of said multifunction key setting module and store said signal into said storage memory, said central processing unit transferring said electronic signal to said radio frequency emitting device to let said radio frequency emitting device emit a remote-control signal when a user presses a key of said handheld remote controller to control said plurality of lamps, a power supply being disposed to provide the required electricity for each of said electronic components.

3. The remote-control device of lamp series control box as claimed in claim 2, wherein said central processing unit is further connected to a buzzing device and an LED emission display.

4. The remote-control device of lamp series control box as claimed in claim 2, wherein said central processing unit is further connected to a computer connector.

5. The remote-control device of a lamp series control box as claimed in claim 1, wherein said central processor is further connected to a voice device.

6. The remote-control device of a lamp series control box as claimed in claim 1, wherein a telephone multi-frequency discrimination device is further disposed between said telephone automatic-answer receiving module and said central processor.

7. The remote-control device of a lamp series control box as claimed in claim 1, wherein said central processor is further connected to a computer connection interface.

8. The remote-control device of lamp series control box as claimed in claim 1, wherein said lamp series control box comprises a central processing unit connected to an RF receiving device, a data storage memory, and a control module, said RF receiving device being used to receive said remote-control signal emitted by said remote controller and a remote-control serial code of said remote controller, said central processing unit being used to discriminate said remote-control signal according to said remote-control serial code set in said data storage memory and send out a control signal to said control module, said control module being connected to a power supply unit, a lamp series output device, and a speaker device.

9. The remote-control device of lamp series control box as claimed in claim 1, wherein said lamp series control box comprises a serial code learning module and a serial code reset module for conveniently learning said remote-control code of said remote controller.

* * * * *